United States Patent [19]

Larsen

[11] 4,032,017

[45] June 28, 1977

[54] ADJUSTABLE BRACKET ASSEMBLY FOR A RAIL CAR COUPLER

[75] Inventor: Glen D. Larsen, Upper Marlboro, Md.

[73] Assignee: Southern Railway Company, Washington, D.C.

[22] Filed: May 13, 1976

[21] Appl. No.: 686,098

Related U.S. Application Data

[63] Continuation-in-part of Ser. No. 572,861, April 29, 1975, Pat. No. 3,987,907.

[52] U.S. Cl. ..... 213/61; 248/295

[51] Int. Cl.[2] ..... B61G 7/12

[58] Field of Search ..... 213/20, 21, 60, 61; 248/295, 298, 287; 285/25, 26; 403/373

[56] References Cited

UNITED STATES PATENTS

| | | | |
|---|---|---|---|
| 1,007,997 | 11/1911 | Wendt | 213/61 |
| 1,661,592 | 3/1928 | Wright | 248/295 X |
| 2,863,570 | 12/1958 | Hicks | 213/60 |
| 2,894,646 | 7/1959 | Hicks | 213/61 X |
| 3,394,821 | 7/1968 | Cordani | 213/61 |
| 3,987,907 | 10/1976 | Larsen | 213/61 |

FOREIGN PATENTS OR APPLICATIONS

| | | | |
|---|---|---|---|
| 828,575 | 12/1969 | Canada | 213/20 |

*Primary Examiner*—Stanley H. Tollberg

*Assistant Examiner*—John P. Shannon

*Attorney, Agent, or Firm*—Watson, Cole, Grindle & Watson

[57] ABSTRACT

A rail car coupler, with the shaft thereof bearing against a coupler carrier, is vertically adjustable by means of serrated lock plates intermeshing with similarly serrated coupler carrier brackets. A minimum adjustment is therefore made possible equal to the size of a tooth of the serrations. Opposed bearing surfaces of the coupler carrier respectively lie in planes containing a trough between a pair of adjacent teeth of the bracket serrations and containing an apex of one of the teeth of the bracket serrations so as to permit a further relative adjustment of the planes containing the bearing surfaces by an amount equal to at least one-half the size of a tooth of the serrations when the coupler carrier is inverted 180°. Serrations may be provided on opposed surfaces of the bracket to facilitate a half-space adjustment by inverting the brackets. In another embodiment, the respective bearing surfaces lie in a plane containing a trough between a pair of adjacent teeth of the bracket and in a plane containing a tooth portion spaced from an apex of one of the teeth of the brackets and lying between the trough and such apex, so as to facilitate a shifting of the planes by an amount equal to the distance that such tooth portion is spaced from such apex, when the brackets are inverted.

9 Claims, 10 Drawing Figures

ADJUSTABLE BRACKET ASSEMBLY FOR A RAIL CAR COUPLER

RELATED APPLICATION

This application is a continuation-in-part of co-pending application Ser. No. 572,861, filed Apr. 29, 1975, U.S. Pat. No. 3,987,907.

BACKGROUND OF THE INVENTION

This invention relates generally to an adjustable bracket, and more particularly to such a bracket for use with a rail car coupler for effecting vertical adjustment of a coupler carrier thereof.

As discussed in the aforementioned application, the coupler extending outwardly of opposite ends of a typical rail car has a shaft extending along the centerline of the draft gear of the car, the shaft being mounted for longitudinal as well as vertical and transverse movements so as to permit continued interengagement during car travel with a similar coupler of an adjacent car. Such a coupler shaft typically rests on a transverse coupler carrier having a wear plate thereon so as to minimize wear. The coupler carrier is supported at opposite ends by carrier brackets which are normally fixedly mounted to side plates on the rail car.

The centerline of a freight car coupler is nominally set at 34-½ inches above the rail. The Interchange Requirements of the Association of American Railroads (AAR) presently require coupler heights for empty cars to be a minimum of 32-½ inches and a maximum of 34-½ inches measured from the top of the rail to the center of the face of the coupler knuckle. For loaded cars coupler heights of a minimum of 31-½ inches and a maximum of 33-½ inches are required and, where possible, adjustments are suggested to be made when the car is empty. This is a typical standard set for all freight cars by the AAR.

When it is desired to adjust the coupler height upwardly in order to comply with the above-noted coupler heights, due to excessive wear of the carrier member wear plate or because the standard coupler height was not maintained by the freight car manufacturer, shims are customarily inserted between the coupler carrier wear plate and the coupler shaft. These coupler carrier shims are required by the AAR to be of a minimum ¼ inch thickness, and may be flat, L-shaped or U-shaped in cross-section so as to be slipped over the coupler carrier wear plate. The coupler must be elevated as by means of a jack or the like to its upper limit in order to carry out this standard procedure. The shim may then be installed beneath the coupler shaft and welded or otherwise secured in place over the wear plate.

The height of the rail car coupler may be adjusted by placing the coupler in the proper alignment with the draft gear of the car using one of the aforedescribed shims where necessary. If less than ¼ inch is required for the shim, realignment is not necessary. Also, where the coupler is in proper alignment and the minimum coupler height has not resulted, further adjustment must be made at the truck springs, center plates or journal boxes of the car. The truck spring shims must be of hardwood of not less than ⅝ inch thickness, or steel of not less than ¼ inch. On the other hand, when the coupler is in proper alignment and height, but is sagging by one inch or more, it must be adjusted by means of the shims as aforedescribed.

It is important to note that the coupler adjustments as described above provide only vertically upward adjustment but no vertically downward adjustment.

It has been found that vertically downward adjustment of the coupler height is oftentimes required especially for newly built rail cars. During the construction of such new cars, the extreme dimensional tolerances in wheels, truck side frames and bolsters, center plates and fabricated roll sections are accumulated to the extent that the coupler height becomes unpredictable. The car builders repeatedly strive to adhere to the AAR requirements set for the coupler height, but are not always successful. Oftentimes, newly built cars are delivered with a coupler height of 35-½ inches. This creates much agony for the car builder and the railroad since the Federal Railroad Administration inspectors may very well condemn the car for the reason that the coupler height for the empty new car at 35-½ inches and the loaded car at a minimum of 31-½ inches would result in a 4 inch differential. Normal vertical oscillations of the car over the road could therefore cause the mated couplers between the cars to become disengaged.

Also, there is a trend toward the use of hardened wear plates located under the coupler shaft of expensive wear resistant steel such as cast manganese. Therefore, introduction of a mild steel shim would only destroy the wear potential of the manganese, or equivalent, coupler carrier wear plate.

The only known coupler height adjuster other than the use of shims is a trunnion hung device having rotated cam wheels at each side. This results in a swing hanger effect under the coupler which is oftentimes undesireable from the standpoint of effectiveness and safety.

SUMMARY OF THE INVENTION

An object of this invention is to provide a means for quickly, effectively and economically adjusting the height of a rail car coupler so as to avoid the aforementioned drawbacks which persist in this coupler adjustment area.

Another object of this invention is to provide such an adjustment means which permits fine adjustment of the bracket members while at the same time avoiding any slippage thereof before and after adjustment.

In carrying out these objects, the coupler height is adjusted as the carrier member and its brackets are shifted vertically a fixed amount determined by means of an intermeshing engagement between serrated surfaces on the brackets and on lock means of the car side plates engaged therewith. Fastening means such as nut and bolt fasteners may be used to secure the adjusted brackets to the lock means. The carrier member is provided with opposed bearing surfaces for alternatively supporting the coupler shaft, the surfaces respectively lying in a plane containing a trough between an adjacent pair of teeth of the serrations on the bracket member and in a plane containing an apex of a tooth of the bracket member serrations, whereby the carrier member may be vertically adjusted a distance equal to at least a size of a tooth of the serrations when the carrier member is in one position, and may be finely adjusted a distance equal to one-half the size of such tooth when the carrier member is in a second position inverted relative to the first position. This inversion may be carried out by rotating the carrier member and its brackets throughout 180° about an axis perpendicular to the side plates. Inversion may alternatively be carried out by rotating the carrier member and its brackets about a central vertical axis thereof. To facilitate this, opposite vertical surfaces of the brackets are serrated, and the apices and troughs of the serrations on one surface respectively lie opposite the troughs and apices of the serrations on an opposing surface.

DETAILED DESCRIPTION OF THE INVENTION

Figure 1:
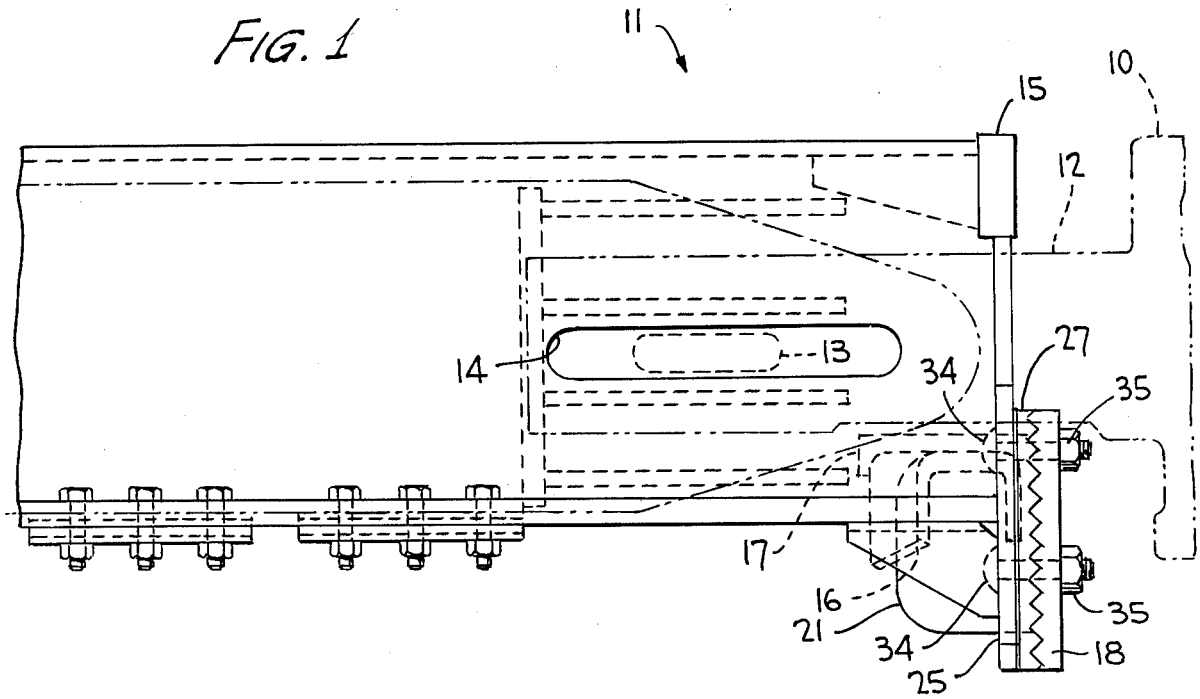
FIG. 1 is a side elevational view of an adjustable bracket assembly according to the invention shown with a portion of a rail car for effecting coupler shaft adjustment.

Turning now to the drawings wherein like reference characters refer to like and corresponding parts throughout the several views, a rail car coupler is shown in phantom outline at 10 in FIG. 1 which further illustrates in side elevation a draft gear pocket 11 typically arranged at the lower side of a freight car which is not otherwise shown. The coupler has a conventional shaft 12 with transversely extending draft keys 13 guided within slots 14 for permitting slight longitudinal movement of the coupler which is cushioned in some typical manner by means located aft of the coupler shaft. A conventional striker plate 15 is located above the coupler shaft so as to define a top wall for the pocket through which the shaft extends outwardly of the rail car. The coupler shaft is supported by a coupler carrier member 16 which spans the coupler shaft therebeneath, and member 16 may be covered by a wear plate 17 in any normal manner. Such wear plate may be of manganese hardened steel, or like material.

Figure 2:
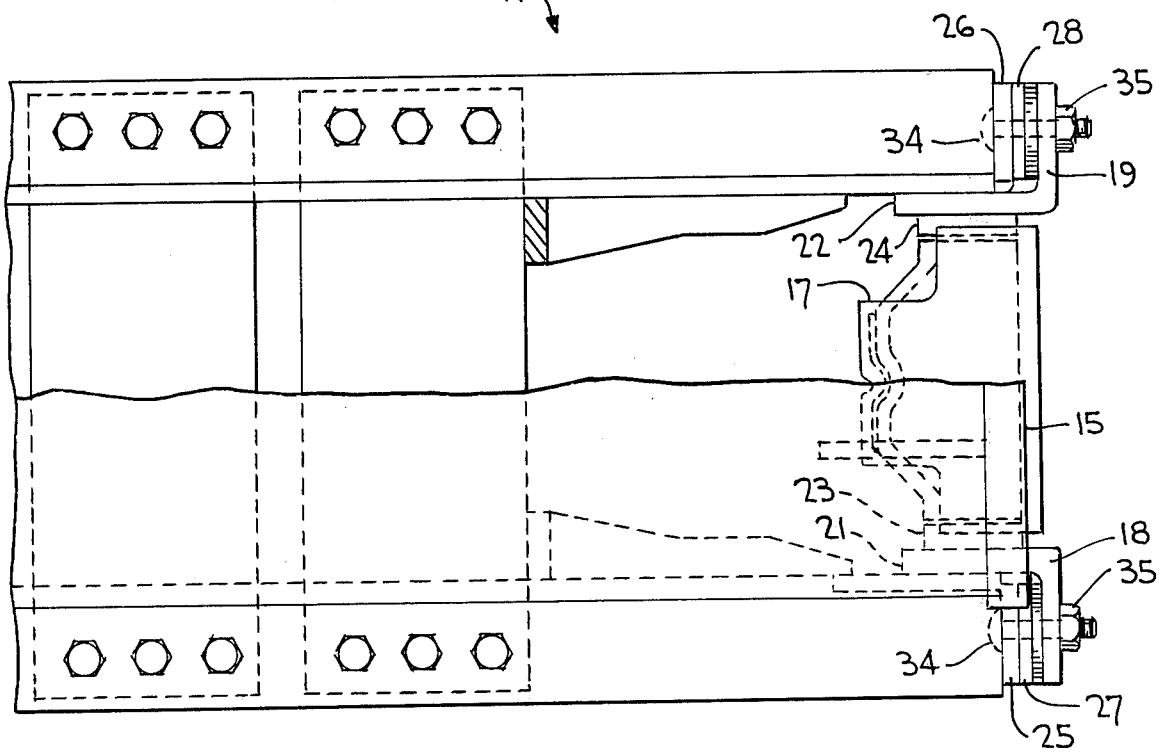
FIG. 2 is a top plan view of the construction shown in FIG. 1.
Figure 3:
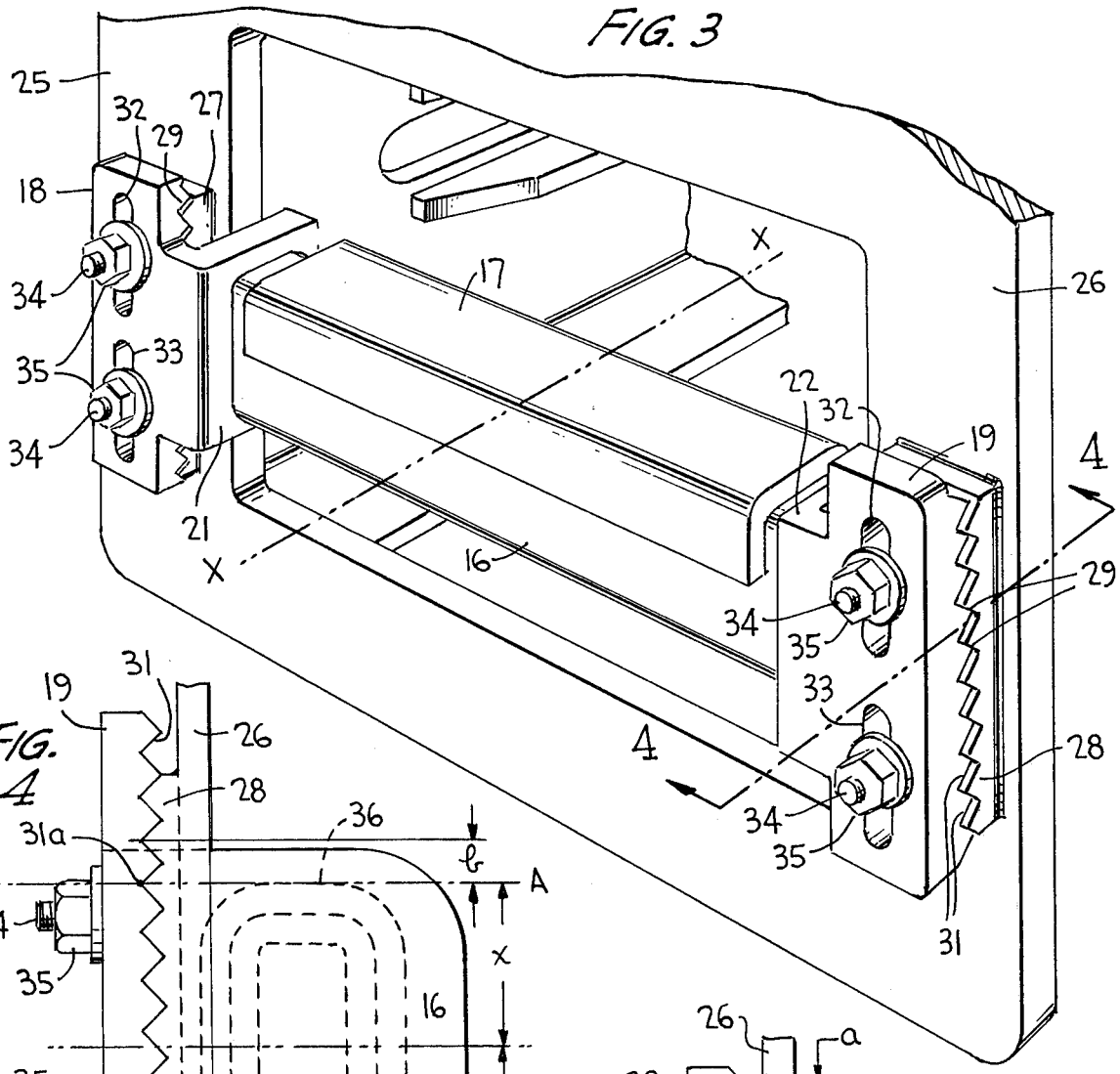
FIG. 3 is a perspective view of the bracket assembly in accordance with the invention.

The carrier member is supported at its opposite ends by means of bracket members 18 and 19 respectively having angled support elements 21 and 22 thereon, as more clearly seen in FIGS. 2 and 3. The support elements are respectively provided with bosses 23 and 24 of an outer dimension slightly less than the inner dimension of hollow carrier member 16 so that the carrier member may be conveniently engaged therewith.

Figure 4:
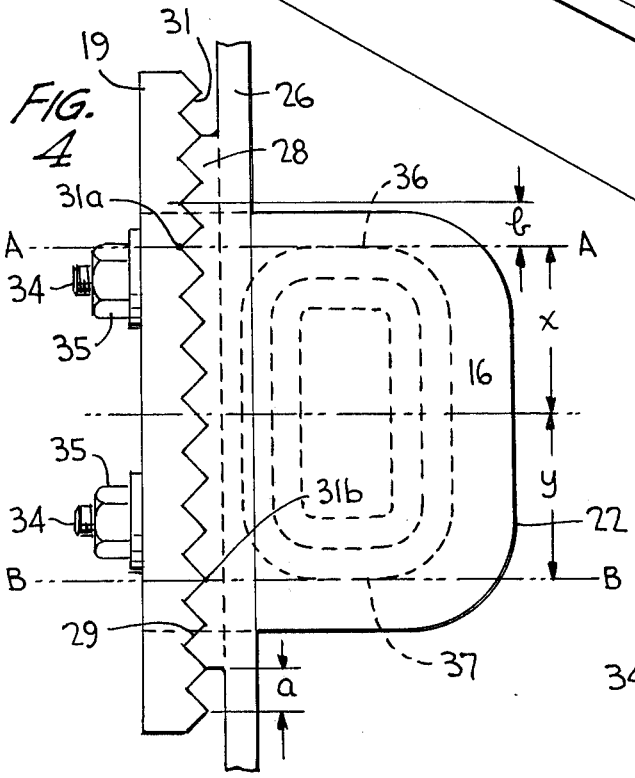
FIG. 4 is a vertical sectional view taken through one end of the bracket assembly substantially along the line 4—4 of FIG. 3.

Side plates 25 and 26 of the draft gear pocket arrangement 11 each have lock plates 27 and 28 welded or otherwise secured thereto, each of such plates being serrated so as to define teeth 29 of identical size and shape extending between the tops and bottoms of the lock plates. Alternatively, teeth 29 may be formed in side plates 25 and 26 so as to be integral therewith. A forward surface of each bracket is likewise serrated so as to define teeth 31 of an identical size and shape as teeth 29 and extending between the top and bottom of each bracket. The teeth of the lock plate and bracket serrations extend horizontally and parallel to the carrier member, and are intermeshed as shown in FIGS. 3 and 4. Vertically elongated openings 32 and 33 are provided in the bracket members, and elongated fasteners such as bolts 34 extend outwardly of the lock plates and through the elongated openings for the purpose of holding the carrier assembly, which includes the carrier member and the brackets, in place on the side plates when nuts 35 are threaded onto the bolts (see also FIGS. 1 and 2).

The brackets, and the coupler carrier which they support, are maintained at the prescribed elevation from the top of the rail by means of the intermeshing engagement between the lock plate teeth and the bracket teeth. By reason of the elongated openings in the brackets, they may be adjusted vertically upwardly or vertically downwardly by simply loosening nuts 35 so as to disengage the lock plate teeth from the bracket teeth whereafter the brackets may be disposed at the required elevation and locked in place as the nuts are again tightened on the bolts. The intermeshing engagement between the lock plates and the bracket teeth avoids any slippage of the vertically adjusted coupler carrier and brackets relative to the lock plates or to the side plates.

Referring to FIG. 4, it can be seen that the bracket members together with the coupler carrier can be adjusted vertically a minimum distance of $b = ½$ inch since the size $a$ of each of the intermeshing teeth is equal to ½ inch. The brackets and carrier member may, of course, be adjusted both vertically upwardly and vertically downwardly a minimum distance of ½ inch in the manner as aforedescribed.

Wear plate 17 is omitted from FIG. 4 for the sake of clarity although it typically extends over a top bearing surface of the hollow carrier member as shown in FIG. 3.

Figure 4A:
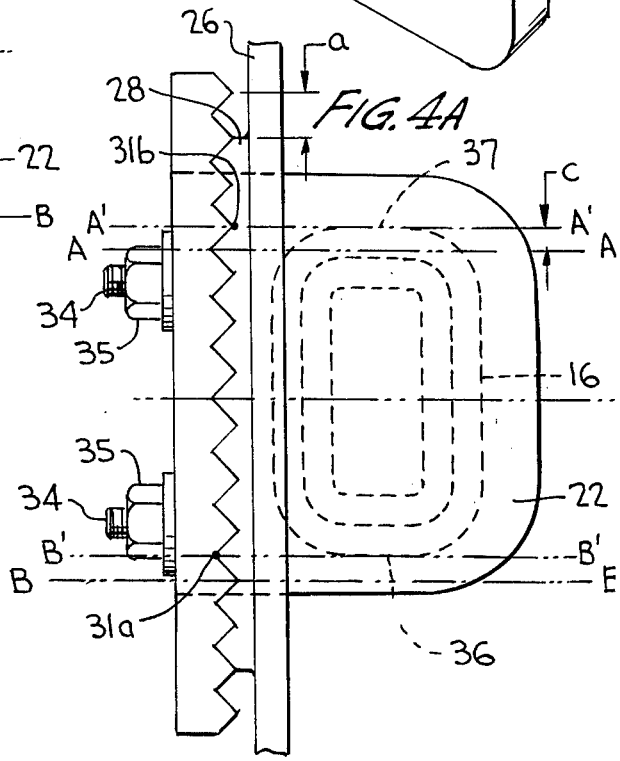
FIG. 4A is a view similar to FIG. 4 except that the half tooth spacing adjustment is shown.

As seen in FIG. 4, bearing surface 36 of carrier member 16 lies in a horizontal plane A which contains a trough 31*a* lying between an adjacent pair of teeth of both bracket members. A bearing surface 37, on an opposed side of the carrier member, lies in a horizontal plane B which contains an apex 31*b* of the teeth of both bracket member serrations. Accordingly, such an arrangement facilitates a vertical adjustment of $c = ¼$ inch (see FIG. 4A), or a half-spacing of a bracket member tooth, as the carrier member including its bracket members are rotated throughout 180° about an axis X extending perpendicularly to the side plates. Of course, nuts 35 are removed and are replaced after such rotation when carrying out such a fine adjustment operation. And, as clearly seen in FIG. 4A, bearing surface 37 now lies in horizontal plane A′ which contains an apex 31*b* of both bracket member teeth while bearing surface 36 lies in a horizontal plane B′ which contains trough 31*a* lying between a pair of adjacent teeth of the bracket members. Hence, the carrier member may be adjusted vertically a distance of $c = ¼$ inch which is one-half the size $a$ of one of the teeth. Therefore, by reason of the particular disposition of the bearing surfaces relative to the bracket member teeth as aforedescribed, a minimum vertical adjustment of one-half the size of a tooth, in this case a distance of ¼ inch, is made possible for the carrier member relative to a reference plane such as A shown in FIGS. 4 and 4A. Naturally, such fine vertical adjustment may be either upwardly or downwardly the same minimum distance relative to the reference plane.

Figure 5:
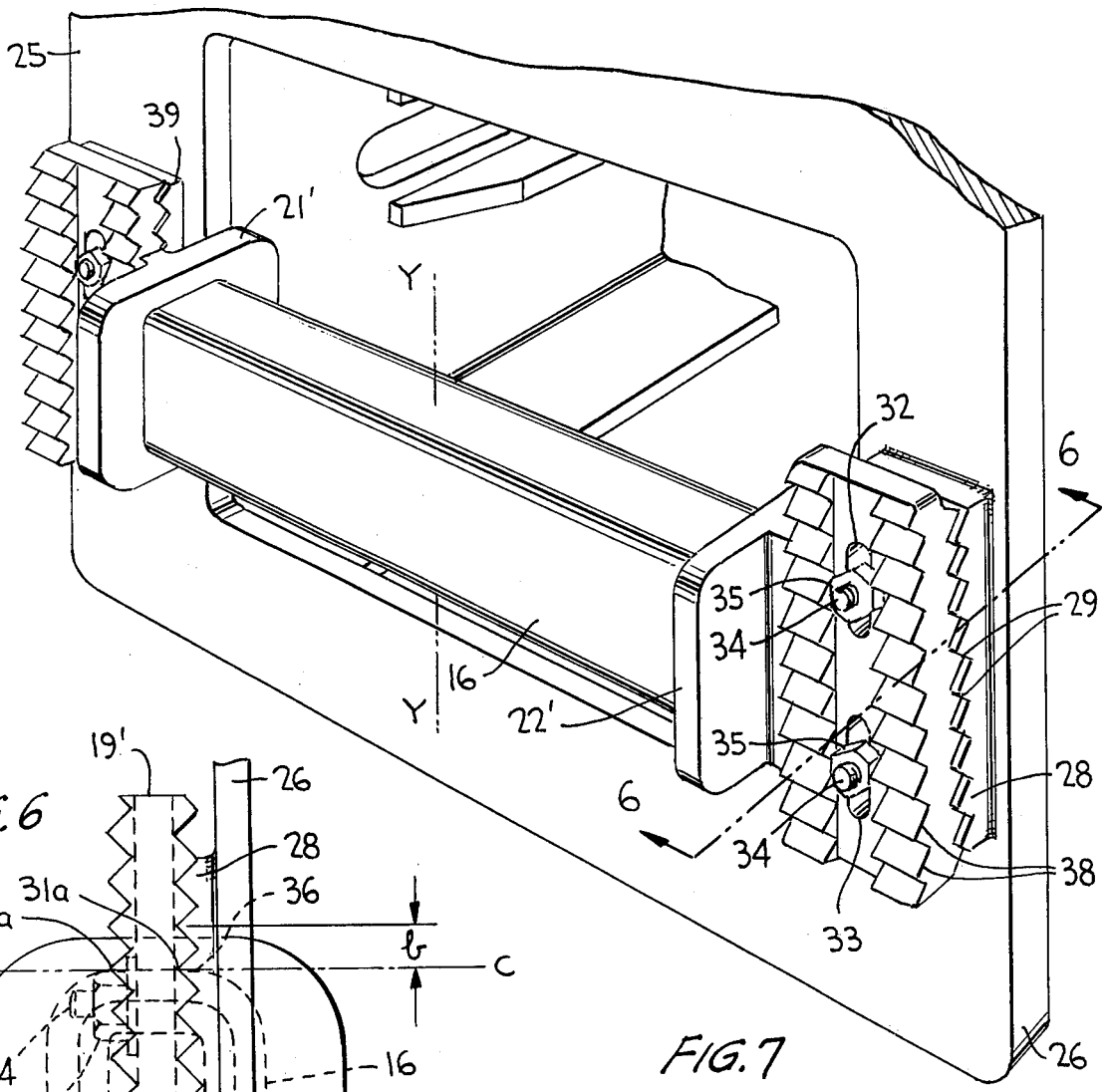
FIG. 5 is a perspective view of another embodiment of a bracket assembly in accordance with the invention.

FIG. 5 illustrates a slight modification of the bracket assembly over that of FIG. 3, wherein the bracket assembly may be finely adjusted a distance equal to $a/2$ by rotating the assembly from its position shown in FIG. 5 throughout 180° about a central vertical axis Y extending through the carrier member and parallel to the side plates. To facilitate such fine adjustment, rearward surfaces of the bracket members lying opposite the serrated surfaces already described are likewise serrated so as to defined teeth 38 of a size $a$ extending between the top and bottom of each bracket member and lying parallel to teeth 31. Also, carrier support elements 21' and 22' are respectively provided on the bracket members with each having boss elements similar to 23 and 24 engageable with carrier member 16 for supporting same similarly as described with reference to the FIG. 3 embodiment. The bracket assembly may be vertically adjusted a distance $b$ which equals a tooth size $a$ in a manner identical to that described with reference to FIG. 4.

Figure 6:
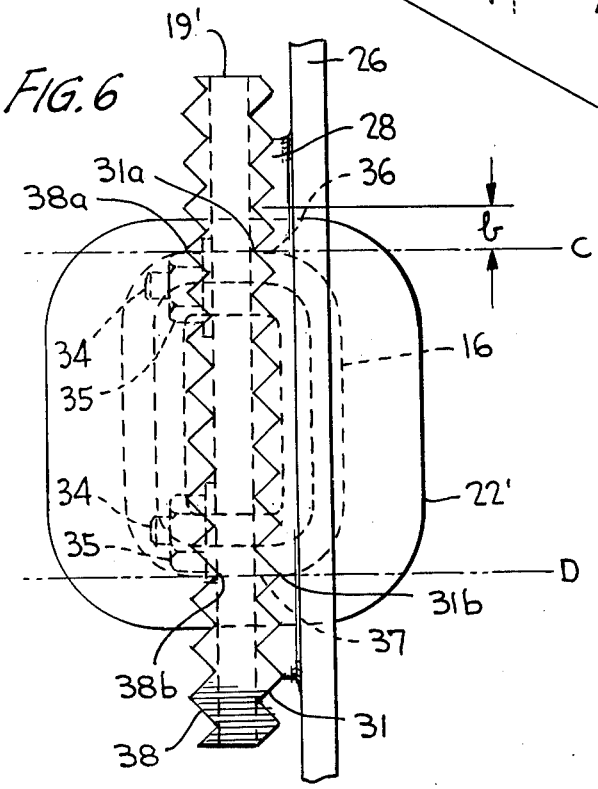
FIG. 6 is a vertical sectional view taken through a portion of the assembly substantially along the line 6—6 of FIG. 5.
Figure 6A:
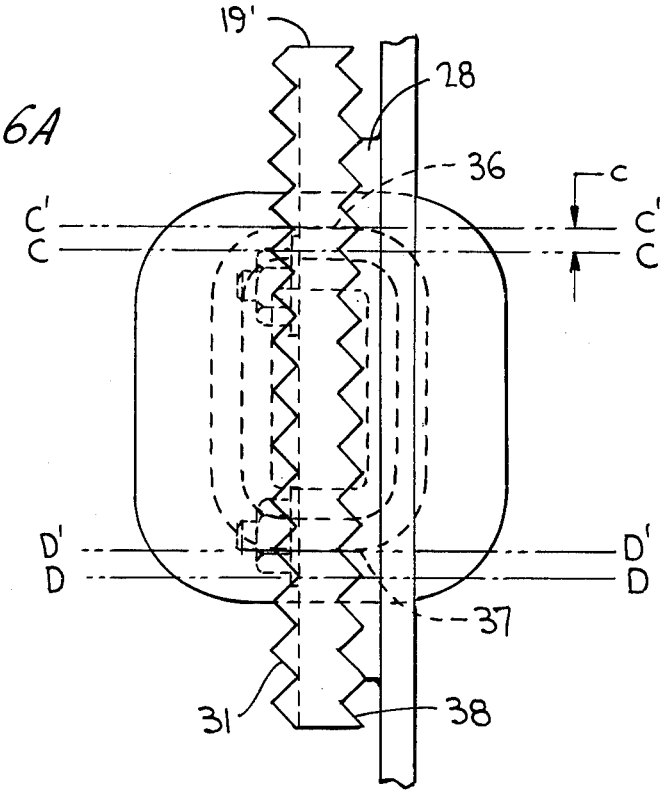
FIG. 6A is a view similar to FIG. 6 except that the half tooth spacing ajustment is shown.

The relative disposition of the carrier member in FIG. 6 to that of bracket member teeth 31 is the same as in FIG. 4. However, teeth 38 are so disposed that their peaks and troughs lie directly opposite the respective troughs and peaks of teeth 31 of the bracket members. Hence, bearing surface 36 lies in a plane C which contains both trough 31*a* of teeth 31 as well as a peak 38*a* of teeth 38 of both bracket members. Similarly, bearing surfaces 37 lies in a plane D which contains peak 31*b* of teeth 31 as well as a trough 38*b* lying between an adjacent pair of teeth 38 of both bracket members. Hence, rotation of the bracket assembly about axis Y into a position of intermeshed engagement between teeth 38 and teeth 29 of the lock plates allows for a fine vertical adjustment $c$ equal to ¼ inch or ½ $a$. This fine vertical adjustment is effected by reason of plane C containing peak 38*a* which is now engaged with a trough of the lock plates spaced a minimum distance $c$ from plane C (see FIG. 6A). The carrier member may therefore be vertically adjusted upwardly so that its bearing surface 36 will lie in a plane C' spaced a small distance $c$ from reference plane C. The same is true for bearing surface 37, and downward vertical adjustment may, of course, be similarly effected for vertical adjustment of the carrier member downwardly of reference plane C.

Figure 7:
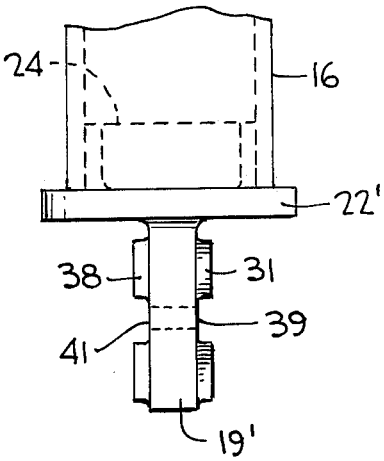
FIG. 7 is a partial top plan view of a bracket member of FIG. 5.

As shown in FIG. 7, opposite surfaces of bracket 19' are devoid of any serrations in areas 39 and 41 in the vicinity of elongated openings 32 and 33 so as to permit nuts 35 or their associated washers to lie flatly against a smooth outer surface of the bracket members regardless of whether teeth 31 or teeth 38 thereof are disposed in meshing engagement with teeth 29 of the lock plates.

Figure 8:
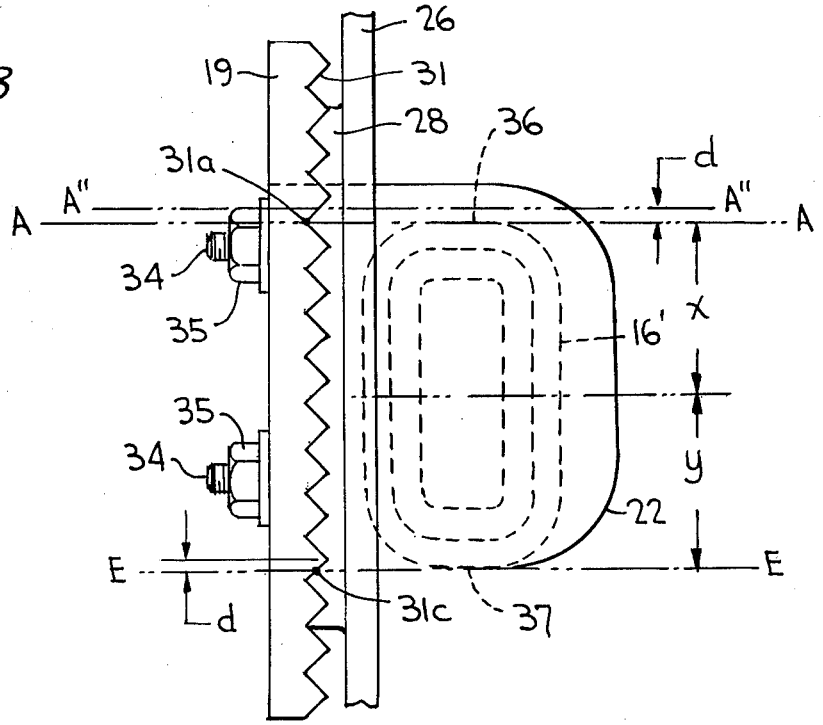
FIG. 8 is a view similar to FIG. 6 except that a bracket assembly in accordance with yet another embodiment is illustrated.

FIG. 8 illustrates yet another modification of the bracket assembly arranged in accordance with the present invention so as to facilitate a fine adjustment of the carrier member a minimum distance $d$ equal to less than ¼ inch or less than ½ the size $a$ of one of the teeth. Bearing surface 36 of carrier member 16' lies in horizontal plane A which contains trough 31*a* of both bracket member teeth 31, similarly as in the FIG. 4 embodiment. However, opposed bearing surface 37 lies in a plane E which contains a portion 31*c* of both bracket member teeth, which portion lies between a peak and a trough of the bracket member teeth. Hence, whereas $x = y$ in FIG. 4, i.e., planes A and B are equidistant from the horizontal centerline of carrier member 16, $y'$ is less than or greater than $x'$ in FIG. 8. Therefore, when distance $y'$ is greater than distance $x'$ by an amount $d$, bearing surface 37 will occupy plane A'' lying at an elevated distance $d$ from reference plane A. Conversely, if distance $y'$ is less than distance $x'$ by an amount $d$, bearing surface 37 will occupy horizontal plane A'' at a lowered distance $d$ from reference plane A upon rotation of the bracket assembly about axis X.

The need for a fine adjustment of the coupler carrier, as aforedescribed, is important because every increment of adjustment made at the coupler carrier location is essentially doubled at the pulling face of coupler 10 at which the elevation from the top of the rail is measured. Such is clearly illustrated schematically in FIG. 6 of U.S. Pat. No. 3,987,907 wherein it is shown that the distance $2y$ therein between the coupler carrier and the pulling face of the coupler is approximately double the distance $y$ therein between the coupler carrier and key 13 at which the coupler and its shaft is essentially pivoted. Therefore, distance $x$ of that Figure between 16 and 16+ or between 16 and 16− is doubled to $2x$ in that Figure between location 10 of the coupler and its adjusted location 10+ or 10−. Therefore, when, as noted in that Figure, $x = ¼$ inch, $2x = ½$ inch at the pulling face of the coupler.

From the foregoing, it can be seen that a simple and economical yet highly effective bracket assembly arrangement has been devised to permit the coupler carrier to be finely adjusted vertically by means of intermeshing and interlocking toothed serrations provided on the brackets and the lock plates without sacrificing the locking quality of the intermeshing teeth. The coupler carrier may be adjusted vertically a minimum distance equal to the size of one tooth without any rotational movement of the carrier assembly being necessary, or a fine adjustment equal to one-half a tooth size is made possible simply upon rotation of the carrier assembly about either of two axes as aforedescribed. Finally, the coupler carrier may be vertically adjusted a minimum distance even less than one-half of a tooth size depending on the relative disposition of the lower bearing surface to that of the bracket member teeth.

Obviously, many other modifications and variations of the present invention are possible in the light of the above teachings. It is therefore to be understood that within the scope of the appended claims, the invention may be practiced otherwise than as specifically described.

What is claimed is:

1. A bracket assembly capable of being incrementally adjusted in opposite directions relative to a plate member, the assembly comprising an elongated member and bracket members at opposite ends of said elongated member for supporting same, said elongated member having opposing bearing surfaces, said bracket members each having at least one elongated opening therein extending along the directions of adjustment, each said bracket member having opposing surfaces lying parallel to said plate member, at least one of said surfaces having toothed serrations thereon of a predetermined tooth size extending perpendicular to the directions of adjustment, lock means on said plate member, said lock means including toothed serrations of a tooth size equal to said predetermined tooth size, fastener elements on said lock means extending through said elongated openings, one of said bearing surfaces lying in a first plane containing a trough between a pair of ajacent teeth of said bracket member serrations, and the other of said bearing surfaces lying in a second plane containing an apex of one of the teeth of said bracket member serrations, said serrations of said bracket members and of said lock means being intermeshed, and said planes being shiftable relative to said plate member, when said elongated member is in a first position, by an amount equal to at least the size of said one of said teeth, and said planes being further shiftable relative to said plate member by an amount equal to at least one-half the size of one of said teeth, when said elongated member is moved to a second position inverted from said first position as by rotating the bracket assembly throughout 180° about an axis perpendicular to said plate member, and means engaging said fastener elements for retaining said bracket members and said lock means together.

2. The bracket assembly according to claim 1, wherein the other of said opposing surfaces of said bracket members has toothed serrations thereon of said predetermined tooth size extending perpendicular to the direction of adjustment, the apices and the troughs between pairs of adjacent teeth of said one surface serrations respectively lying opposite the troughs between pairs of adjacent teeth and the apices of said other surface serrations, whereby said elongated member may be inverted from said first position into said second position upon rotating the bracket assembly throughout 180° about an axis parallel to said hearing surfaces.

3. The bracket assembly according to claim 1, wherein said lock means comprise lock plates fixedly secured to said plate member.

4. The bracket assembly according to claim 2, wherein said fastener elements comprise bolts and said engaging means comprise nuts, both said opposing surfaces having unserrated and smooth portions in the vicinity of said elongated openings to accommodate said nuts when engaged with said bolts.

5. A bracket assembly capable of being incrementally adjusted in opposite directions relative to a plate member, the assembly comprising an elongated member and bracket members at opposite ends of said elongated member for supporting same, said elongated member having opposing bearing surfaces, said bracket members each having at least one elongated opening therein extending along the directions of adjustment, each said bracket member having opposing surfaces lying parallel to said plate member, at least one of said surfaces having toothed serrations thereon of a predetermined tooth size extending perpendicular to the direction of adjustment, lock means on said plate member, said lock means including toothed serrations of a tooth size equal to said predetermined tooth size, fastener elements on said lock means extending through said elongated openings, one of said bearing surfaces lying in a first plane containing a trough between a pair of adjacent teeth of said bracket member serrations, and the other of said bearing surfaces lying in a second plane containing a tooth portion spaced from an apex of one of said teeth of said bracket member serrations and lying between said trough and said apex, said serrations of said bracket members and of said lock means being intermeshed, said planes being shiftable relative to said plate member, when said elongated member is in a first position, by an amount equal to at least the size of said one of said teeth, and said planes being further shiftable relative to said plate member by an amount equal to the distance said tooth portion is spaced from said apex, when said elongated member is moved to a second position inverted from said first position, and means engaging said fastener elements for retaining said bracket members and said lock means together.

6. In a rail car with a coupler having its shank portion resting on a coupler carrier member and bracket members supporting said carrier member at opposite ends thereof, said bracket members and said carrier member comprising a bracket assembly capable of being incrementally adjusted vertically relative to side plates of the rail car, said carrier member having opposing bearing surfaces, said bracket members each having at least one vertically elongated opening therein, each said bracket member having opposing surfaces lying parallel to said side plates, at least one of said surfaces having horizontally extending toothed serrations thereon of a predetermined tooth size, lock means on said side plates, said lock means including toothed serrations of a tooth size equal to said predetermined tooth size, fastener elements on said lock means extending through said elongated openings, one of said bearing surfaces lying in a plane containing a trough between a pair of adjacent teeth of said bracket member serrations, and the other of said bearing surfaces lying in a second plane containing an apex of one of the teeth of said bracket member serrations, said serrations of said lock means and of said bracket members being intermeshed, and said planes being shiftable relative to said side plates, when said carrier member is in a first position, by an amount equal to at least the size of said one of said teeth, said planes being further shiftable relative to said side plates by an amount equal to at least one-half the size of said teeth, when said carrier member is moved to a second position inverted from said first position as by rotating the bracket assembly 180° about an axis perpendicular to said side plates, and means engaging said fastener elements for retaining said bracket members and said lock means together.

7. The bracket assembly according to claim 6, wherein the other of said opposing surfaces of said bracket members has toothed serrations thereon of said predetermined tooth size extending perpendicular to the direction of adjustment, the apices and the troughs between pairs of adjacent teeth of said one surface serrations respectively lying opposite the troughs between pairs of adjacent teeth and the apices of said other surface serrations, whereby said elongated member may be inverted from said first position into said second position upon rotating the bracket assembly throughout 180° about an axis parallel to said bearing surfaces.

8. The bracket assembly according to claim 6, wherein said lock means comprise lock plates fixedly secured to said plate member.

9. The bracket assembly according to claim 7, wherein said fastener elements comprise bolts and said engaging means comprise nuts, both said opposing surfaces having unserrated and smooth portions in the vicinity of said elongated openings to accommodate said nuts when engaged with said bolts.

* * * * *